US009739106B2

(12) United States Patent
Tse

(10) Patent No.: US 9,739,106 B2
(45) Date of Patent: Aug. 22, 2017

(54) ANGLED SEGMENTED BACKUP RING

(71) Applicant: SCHLUMBERGER TECHNOLOGY CORPORATION, Sugar Land, TX (US)

(72) Inventor: Kyle Tse, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 174 days.

(21) Appl. No.: 14/528,049

(22) Filed: Oct. 30, 2014

(65) Prior Publication Data

US 2016/0123100 A1 May 5, 2016

(51) Int. Cl.

| | |
|---|---|
| ***E21B 23/06*** | (2006.01) |
| ***E21B 33/128*** | (2006.01) |
| ***E21B 33/12*** | (2006.01) |
| ***E21B 33/129*** | (2006.01) |

(52) U.S. Cl.

CPC ..... *E21B 23/06* (2013.01); *E21B 33/128* (2013.01); *E21B 33/129* (2013.01); *E21B 33/1216* (2013.01); *E21B 33/1292* (2013.01)

(58) Field of Classification Search

CPC ..... E21B 23/01; E21B 23/06; E21B 33/128; E21B 33/129; E21B 33/1291

USPC ..... 166/118, 138, 196, 216, 217; 277/342, 277/339, 340

See application file for complete search history.

(56) References Cited

U.S. PATENT DOCUMENTS

| | | | | |
|---|---|---|---|---|
| 2,797,758 | A * | 7/1957 | Showalter | E21B 33/12 166/187 |
| 3,298,440 | A * | 1/1967 | Current | E21B 23/06 166/123 |
| 7,665,516 | B2 * | 2/2010 | Roberts | E21B 23/01 166/118 |
| 8,016,295 | B2 * | 9/2011 | Guest | E21B 33/1216 277/584 |
| 8,167,033 | B2 * | 5/2012 | White | E21B 33/1216 166/134 |
| 8,205,671 | B1 * | 6/2012 | Branton | E21B 33/1216 166/118 |
| 8,479,809 | B2 * | 7/2013 | Farquhar | E21B 33/128 166/196 |
| 8,997,859 | B1 * | 4/2015 | Ackermann | E21B 33/134 166/242.8 |
| 9,169,711 | B2 * | 10/2015 | Raynal | E21B 33/03 |
| 2010/0263857 | A1 * | 10/2010 | Frazier | E21B 33/134 166/127 |
| 2011/0101615 | A1 * | 5/2011 | Clarke | E21B 33/1216 277/336 |
| 2012/0217025 | A1 | 8/2012 | Shkurti et al. | |

* cited by examiner

*Primary Examiner* — Kenneth L Thompson
(74) *Attorney, Agent, or Firm* — Jeffery R. Peterson

(57) ABSTRACT

An angled segmented backup ring includes a plurality of slots extending radially inward from an outer surface and extending axially parallel to one another and non-parallel to a longitudinal axis and a plurality of the segments defined by the plurality of slots. The adjacent segments may overlap one another in the axial direction.

16 Claims, 5 Drawing Sheets

ANGLED SEGMENTED BACKUP RING

BACKGROUND

This section provides background information to facilitate a better understanding of the various aspects of the disclosure. It should be understood that the statements in this section of this document are to be read in this light, and not as admissions of prior art.

In the drilling, completing, or reworking of oil wells, a great variety of downhole tools are used. For example, but not by way of limitation, it is often desirable to seal tubing or other pipe in the casing of a well, such as when it is desired to pump cement or other slurry down the tubing and force the cement or slurry around the annulus of the tubing or out into a formation. In some instances, perforations in the well in one section need to be isolated from perforations in a second section of the well. Typically, the wellbore is lined with tubular or casing to strengthen the sides of the borehole and isolate the wellbore from the surrounding earthen formation. In order to access production fluid in a formation adjacent the wellbore, the casing is perforated, allowing the production fluid to enter the wellbore and be retrieved at the surface of the well. In other situations, there may be a need to isolate the bottom of the well from the wellhead. It then becomes necessary to seal the tubing with respect to the well casing to prevent the fluid pressure of the slurry from lifting the tubing out of the well or for otherwise isolating specific zones in which a wellbore has been placed. In other situations, there may be a need to create a pressure seal in the wellbore allowing fluid pressure to be applied to the wellbore to treat the isolated formation with pressurized fluids or solids. Downhole tools, referred to as packers and plugs, are designed for the aforementioned general purposes, and are well known in the art of producing oil and gas.

Traditional packers include a sealing element having anti-extrusion backup rings on both upper and lower ends and a series of slips above and/or below the sealing element. Typically, a setting tool is run with the packer to set the packer. The setting may be accomplished hydraulically due to relative movement created by the setting tool when subjected to applied pressure. This relative movement causes the slips to move cones up and extend into the surrounding tubular. At the same time, the sealing element may be compressed into sealing contact with the surrounding tubular. The set may be held by a body lock ring, which may prevent reversal of the relative movement. Additionally, a packer may be run into the wellbore as part of the liner string, which would be the case with a multi zone open hole frac (or fracturing) system.

The downhole isolation tool may be run in conjunction with other downhole tools, including, for example, a sleeve coupled to a ball seat, frac plugs, bridge plugs, etc. The downhole isolation tool may be set by wireline, coil tubing, or a conventional drill string. The tool may be run in open holes, cased holes, or other downhole completion systems. The downhole isolation tool and other downhole tools may be removed by drilling through the tool and circulating fluid to the surface to remove the drilled debris.

Existing sealing element anti-extrusion backup designs use three concepts, or a combination, to achieve containment of the element rubber during a high pressure pack-off at high temperature. The traditional designs include split rings, metal petal backup rings, and segmented backup rings.

Split ring element backup designs use two split rings with the scarf cuts opposed 180 degrees. Once the element setting pressure is applied, the rings expand radially outward and contact the casing inner diameter. Although the split section in the rings are opposed, and do not provide a continuous extrusion path, the width between the ends of the rings provide a significant volume for the element rubber to extrude into. This can decrease the rubber pressure in the element, limiting the sealing ability of the packer.

The metal petal design is a thin cup shaped ring that has been cut into petal segments on the outer diameter of the ring. When a compressive force is applied to the packer element during the setting procedure, the metal petals flex outwards and contact the casing wall. The petals trap the element rubber from extruding outwards past the clearance between the packer outer diameter and the casing inner diameter, due to the outward pressure on the petals from the element rubber and the friction between the petals and the casing inner diameter. While the overall extrusion gap has been limited by the petals, the gap between the petals created during the radial expansion becomes an extrusion gap for the element rubber. The metal petal concept can use multiple stacked metal petals to reduce the extrusion gap. Specifically, the cuts in the petal rings are offset so that there is no direct path for the rubber to extrude.

Another method used to limit sealing element extrusion is a segmented backup ring. This design uses a ring that has been cut axially on the outer diameter, segmenting the ring into small axial pieces. Usually the cuts have not been made completely through so the ring is still whole. Segmented backup rings have a tapered face and use a solid cone on the mandrel to push the segments radially outward during the setting process. When the packer setting pressure is applied, the ring is compressed against the cone. This breaks the segments into individual parts as they move to contact the casing inner diameter. Usually the segments are also guided as they expand so that the spacing between the segments will be equal. Multiple segmented rings can be offset so that no gap exists for the element rubber to extrude into. In certain applications, a combination of the metal petal and segmented ring design can be used to limit extrusion through the axial gaps created along the cuts when the segmented ring is compressed.

SUMMARY

An angled segmented backup ring according to aspects of the disclosure includes a plurality of slots extending radially inward from an outer surface and extending axially parallel to one another and non-parallel to a longitudinal axis and a plurality of the segments defined by the plurality of slots. The adjacent segments may overlap one another in the axial direction. An isolation device in accordance to an embodiment includes a first ring end of the angled segmented barrier ring disposed adjacent to a first element end of a radially expandable tubular seal element.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
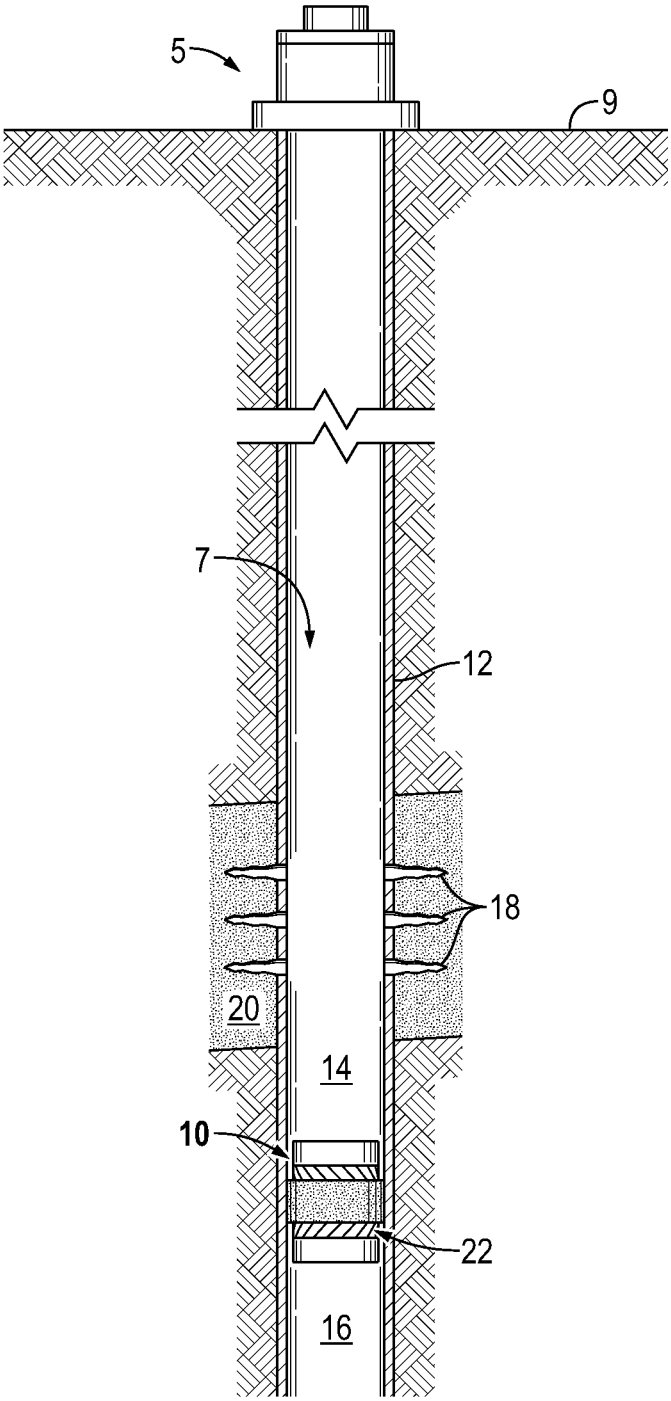
FIG. 1 illustrates a well system incorporating an isolation device and an angled segmented backup ring according to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface.

FIG. 1 illustrates a well 5 with a wellbore 7 in which an expandable isolation system or device 10 is deployed. Isolation device 10 may be attached to a setting tool and run into the hole on a conveyance such as wireline or tubing and then actuated to radially expand the sealing element of the device into contact with the wellbore wall. In FIG. 1, isolation device 10 is set in casing 12 isolating an upper zone 14 of the wellbore from a second or lower zone 16 of the wellbore relative to the surface 9. Perforations 18 are formed through casing 12 and providing fluid communication with the surrounding formation 20. Isolation device 10, e.g. packer, bridge plug, frac plug (i.e., fracturing plug), may be utilized for various wellbore operations, or applications, as will be understood by those skilled in the art with benefit of this disclosure. FIG. 1 is merely an illustration of one use of isolation device 10 and angled segmented backup ring 22 and the use and implementation of the angled segmented backup ring 22 is not limited to wellbore tools or operations.

Referring generally to FIGS. 2 through 6, aspects of embodiments of an isolation device 10 and an expandable angled segmented backup ring 22 are described. Isolation device 10 includes an angled segmented backup ring 22 disposed with a packer or sealing element 24. Sealing element 24 is a tubular member extending along a longitudinal axis 26 of the sealing element 24, angled segmented backup ring 22 and the isolation device 10. Sealing element 24 extends along axis 26 between opposing ends 28, 30. When axially compressed, sealing element 24 expands radially, see e.g. FIGS. 4 and 6.

Sealing element 24 may be constructed of various elastomeric materials, including without limitation a nitrile rubber, for example a hydrogenated nitrile butadiene rubber ("HNBR"), or fluoroelastomers. The depicted sealing element 24 includes an element end ring (e.g., triangle ring) 36 disposed circumferentially along the end 30 of sealing element 24. Element end ring 36 may be formed for example of a phenolic plastic, for example a fiber impregnated phenolic plastic. For example, element end ring 36 may be bonded to the end of the seal element or element end ring 36 may be molded with the seal element such that seal element and the element end ring form a single component. The illustrated element end ring 36 includes axially outward extending members 38 (e.g., splines, tabs) that are configured to mate with corresponding elements, e.g., recesses, pockets, of another part of the isolation device. For example, with reference to FIG. 9, element 38 may mate with cone 58 to limit the rotation of the backup ring about the mandrel for example if the isolation device is being drilled out of a wellbore. In accordance to some embodiments, an element end ring 36 is not utilized with the isolation device 10.

Angled segmented backup ring 22 extends axially from a first or inner end 32 to a second or outer end 34. Angled segmented backup ring 22 has an inner surface 40 and an outer surface 42. Inner surface 40 includes a sloped inner surface 44 (FIGS. 3, 4) that slopes starting at first ring end 32 radially inward and axially in the direction of second ring end 34. A plurality of cuts or slots 46 are present on the outer surface 42 and extend radially inward from the outer surface 42 toward inner surface 40. In accordance to some embodiments, the slots 46 do not extend radially all the way through the backup ring. For example, in some embodiments slots 46 do not extend through the inner surface 40 or at least do not extend fully through inner surface 40 axially from the first end to the second end. Slots 46 extend through the outer surface from the first end 32 to the second end 34 at a non-straight angle relative to the longitudinal axis 26. Slots 46 extend parallel to one another and non-parallel to longitudinal axis 26. The plurality of slots 46 form segments 48, each of the segments being defined by a sequential pair of the slots 46. The adjacent segments 48 overlap one another across the angled slot 46 in the axial direction parallel to axis 26. When the angled segmented backup ring is radially expanded the adjacent segments 48 overlap one another in the axial direction minimizing or eliminating an axially extending open gap thereby resisting axial extrusion of element 24 when it is expanded for example into sealing contact with an outer circumferential surface. For example, with reference to the expanded isolation device illustrated in FIGS. 4 and 6 an open axial path is not formed through the length of angle slots 46. Angled segmented backup ring 22 may be formed of various materials such as metals and composite materials, for example plastics.

Figure 9:
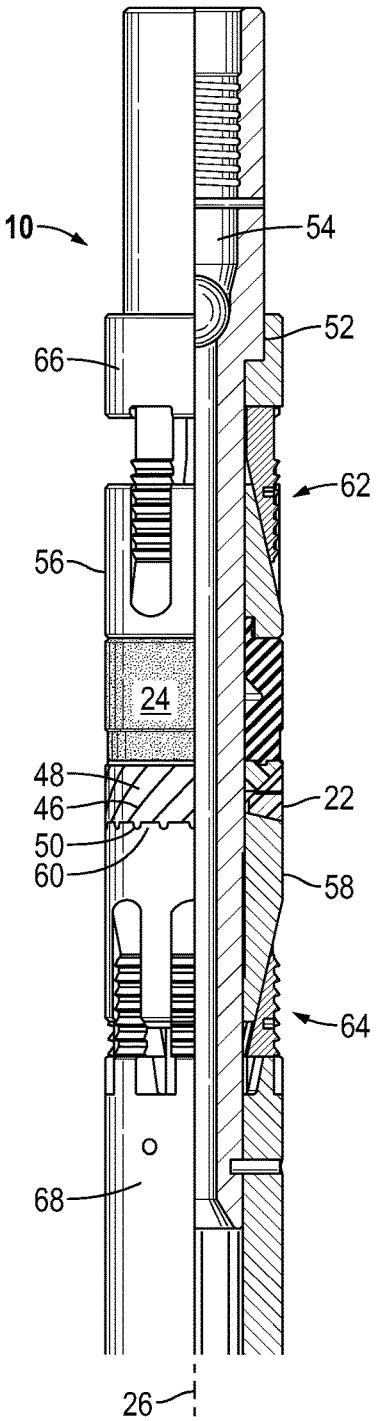
FIG. 9 illustrates a downhole isolation device utilizing an angled segmented backup ring according to one or more aspects of the disclosure.
Figure 10:
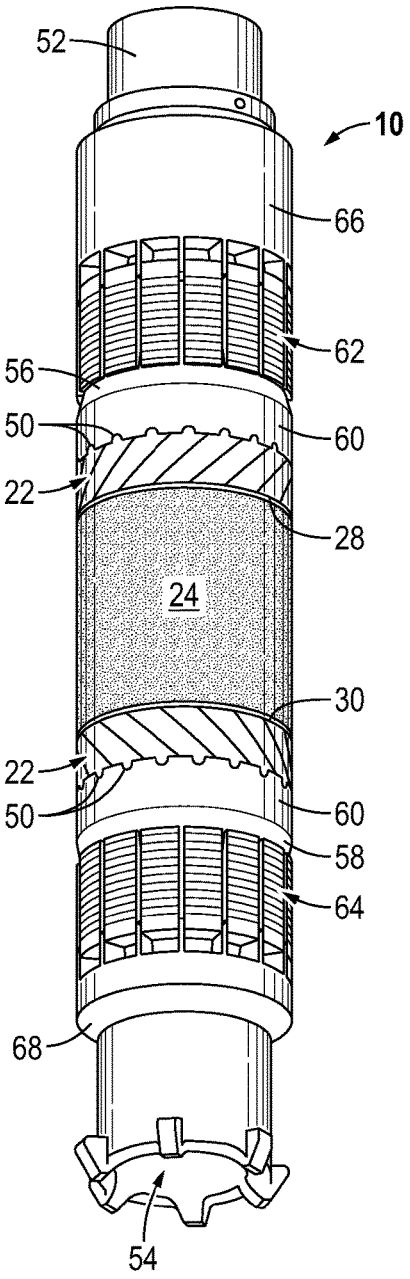
FIG. 10 illustrates a downhole isolation device utilizing an angled segmented backup ring according to one or more aspects of the disclosure.

In accordance to some embodiments, each of the segments includes a guide element 50, referred to as a protrusion herein, located on the second or outer ring end 34. Guide element or protrusion 50 (e.g., castellation) is provided to mate with corresponding guide element of a member (e.g., cone, guide ring) of the isolation device, for example as illustrated in FIGS. 9 and 10. The corresponding guide elements may be utilized to maintain the segments 48 in an even spacing as they break up and separate when the isolation device is expanded.

Figure 2:
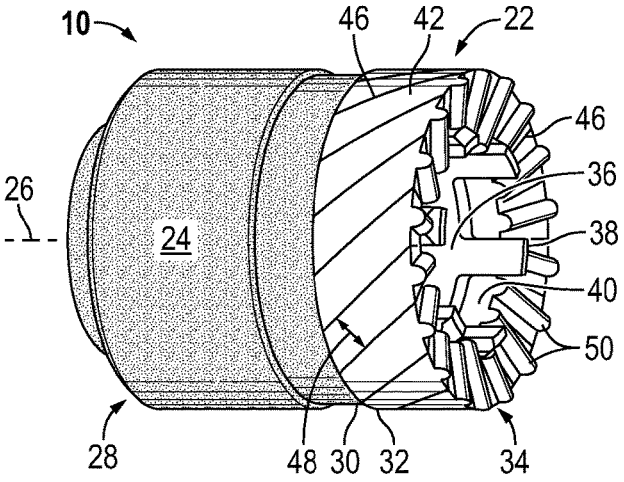
FIG. 2 is a perspective view of an isolation device according to one or more aspects of the disclosure.
Figure 3:
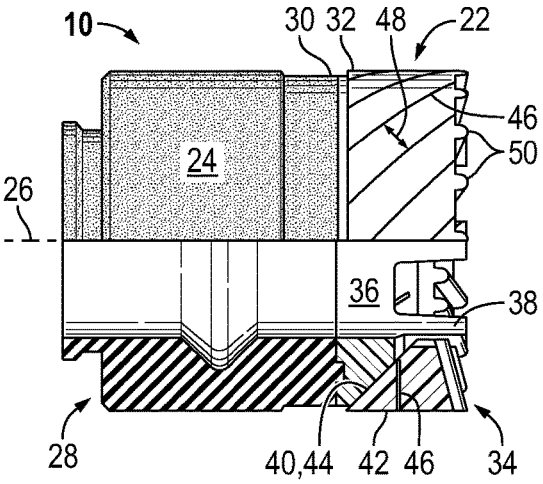
FIG. 3 is a cut-away view of a non-expanded isolation device and an angled segmented backup ring along the line 3-3 of FIG. 5.

In the non-expanded or unset position or state, as illustrated for example in FIGS. 2 and 3, first end 32 is positioned proximate to element end 30 or axially away from the seal element and end 30. To radially expand seal element 24, seal element 24 and angled segmented backup ring 22 are axially compressed moving first end 32 of the backup ring axially toward the sealing element. As the elements are being axially compressed the sloped inner surface 44 of the backup ring moves across element end 30 which acts as a ramp expanding angled segmented backup ring 22 radially outward. The width of the slots 46 expand allowing the diameter of the backup ring to deform and increase in diameter as illustrated in FIGS. 4 and 6.

Figure 5:
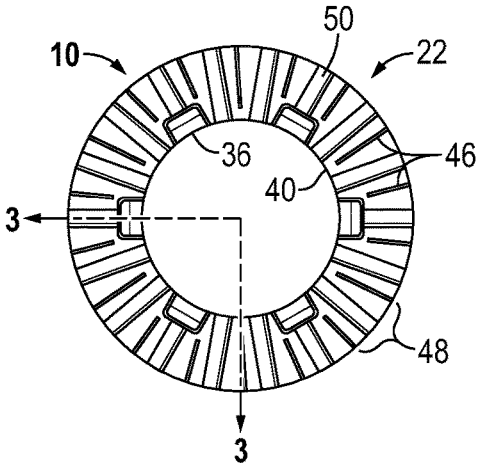
FIG. 5 is an end view of a non-expanded angled segmented backup ring according to one or more aspects of the disclosure.
Figure 6:
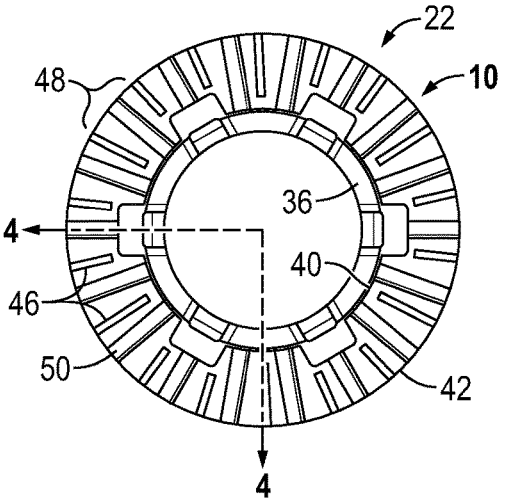
FIG. 6 is an end view of an expanded angled segmented backup ring according to one or more aspects of the disclosure.

FIG. 5 is an end view of a non-expanded angled segmented backup ring 22 having angled slots 46 and FIG. 6 is an end view of an expanded angled segmented backup ring 22 having angled slots 46. FIGS. 5 and 6 illustrate how the slots 46 increase in width as the angled segmented backup ring is radially expanded. FIGS. 5 and 6 illustrate how the adjacent elements overlap thereby eliminating axially extending open gaps, for example at angled slots 46, from the first ring end to the second ring end.

Figure 4:
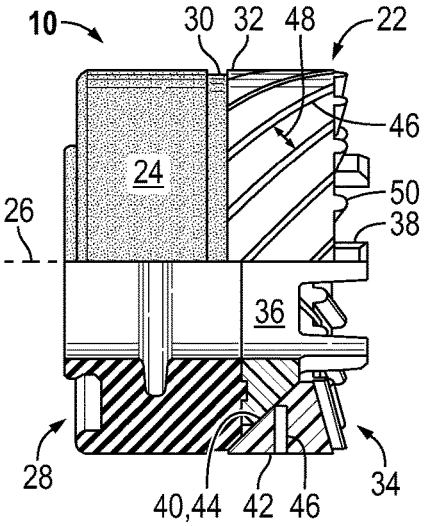
FIG. 4 is a cut-away view of an expanded isolation device and an angled segmented backup ring along the line 4-4 of FIG. 6.
Figure 11:
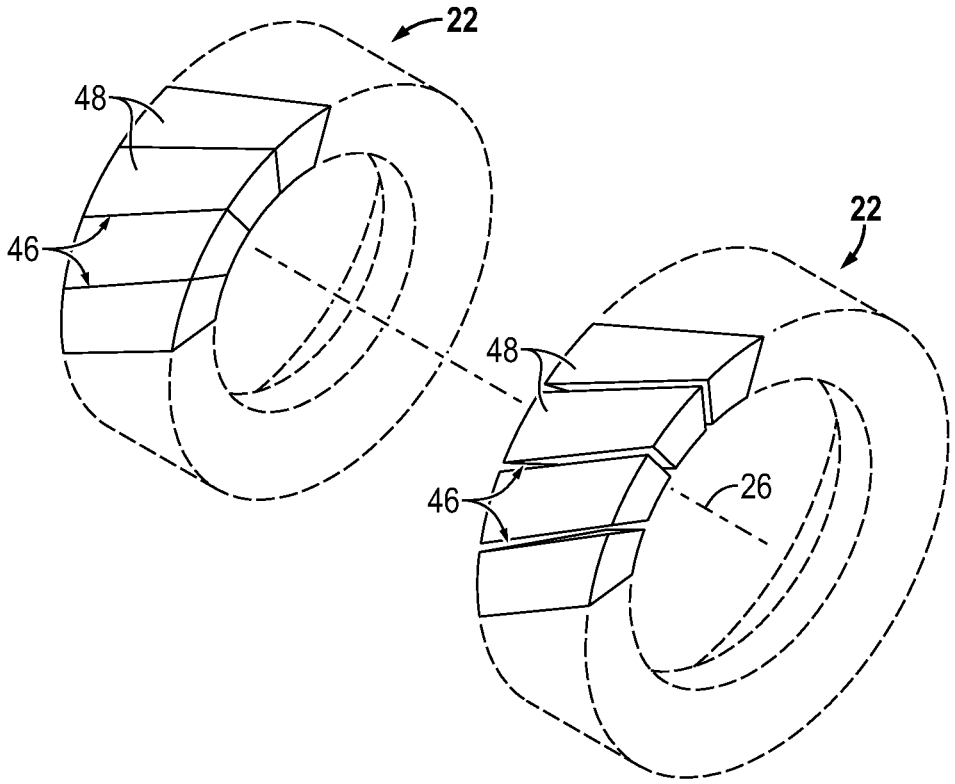
FIG. 11 schematically illustrates the radial expansion of an angled segmented backup ring according to one or more aspects of the disclosure.

FIGS. 3 and 4 illustrate cut-away views of the non-expanded and of the expanded angled segmented backup ring 22 of FIGS. 5 and 6 respectively. FIG. 11 schematically illustrates the radial expansion of an angled segmented backup ring 22. FIGS. 3, 4 and 11 illustrate how the angled slots 46 expand in width as the segments 48 expand radially while maintaining an overlap of the adjacent backup ring segments 48 in the axial direction. Because the expanding width of the angled slot 46 between the adjacent ring segments does not compromise the overlap of the adjacent ring segments 48 the need for a secondary backup ring to prevent axial extrusion of the element 24 is mitigated if not entirely eliminated. Further, it is indicated that axial flexing of the angled segmented backup ring 22 occurs as the isolation device is compressed resulting in a smaller than expected angled slot 46 width, i.e., gap, between adjacent segments 48 improving the resistance to element extrusion provided by the angled segmented backup ring 22.

Figure 7:
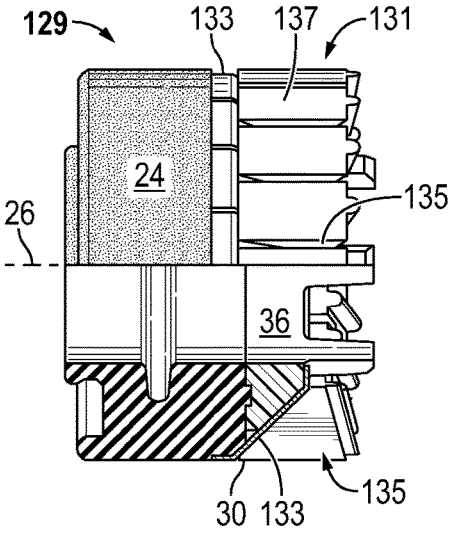
FIG. 7 (Prior Art)
FIG. 7 is a cut-away view of the expanded isolation device and prior art straight segmented backup ring long the line 7-7 of FIG. 8.
Figure 8:
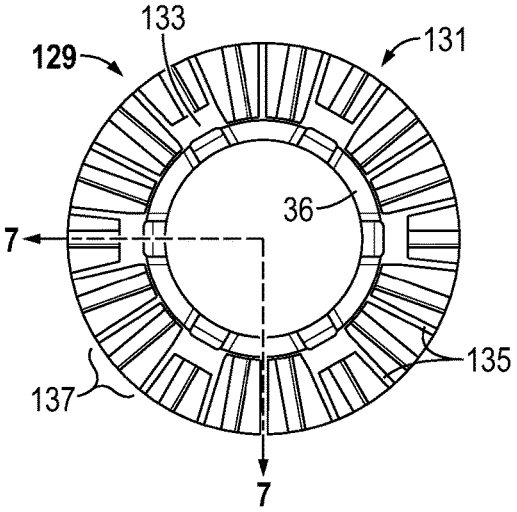
FIG. 8 (Prior Art)
FIG. 8 is an end view of an expanded prior art straight segmented backup ring according to one or more aspects of the disclosure.

FIG. 7 illustrates a prior art isolation device 129 sectioned along the line 7-7 of FIG. 8. Prior art isolation device 129 includes a segmented backup ring 131, i.e., straight segmented backup ring, and a secondary backup ring or barrier element 133. The secondary backup ring 131 is positioned between the element end 30 of the sealing element 24 and the straight segmented backup ring 131. Prior art straight segmented backup ring 131 includes a plurality of straight slots 135 that extend parallel with the longitudinal axis 26. When the straight segmented barrier ring 131 expands, the adjacent segments 137 separate from one another creating an expanded axial slot 135 extending between the segments the length of the barrier ring creating an axial path through which the seal element 24 can extrude. Accordingly, the prior art isolation device includes secondary backup ring 133 to prevent extrusion of the element 24 into the expanded straight axial slots 135 that extend axially between the opposing ends of the segmented barrier ring 131. FIG. 7 illustrates the open slot 135 extending axially from the end of the element, for example the element end ring, to the outer terminal end of the segmented barrier ring.

FIG. 9 illustrates a downhole isolation device 10 utilizing an angled segmented backup ring 22 according to some embodiments of the disclosure. Isolation device 10 is illustrated configured in the form of a wellbore tool such as a drillable plug, for example a bridge plug or frac (i.e., fracturing plug). Sealing element 24 is disposed on a mandrel 52 having a through bore 54 extending along longitudinal axis 26. Upper and lower cones 56, 58 are disposed around the mandrel and positioned on opposing sides of seal element 24. In FIG. 9 an angled segmented backup ring 22 is positioned between the lower cone 58 and the sealing element. The guide elements 50 are illustrated engaged with guide elements 60 (e.g., pocket, castellation, etc.). Upper and lower slips 62, 64 are disposed around the mandrel and adjacent upper and lower cones 56, 58 respectively. Upper and lower gage rings 66, 68 are disposed adjacent to and engage upper and lower slips 62, 64.

FIG. 10 illustrates a downhole isolation device 10 utilizing an angled segmented backup rings on opposing ends of a sealing element. Sealing element 24 is disposed on a mandrel 52 having a through bore 54. Upper and lower cones 56, 58 are disposed around the mandrel and positioned on opposing sides of seal element 24. An upper angled segmented backup ring 22 is positioned between an upper end of 28 of seal element 24 and upper cone 56. A lower angled segmented backup ring 22 is positioned between the lower cone 58 and the lower end 30 of the sealing element. The guide elements 50 are illustrated engaged with guide elements 60 (e.g., pocket, castellation, etc.), which may be for example guide rings or a portion of the respective cones 56, 58. Upper and lower slips 62, 64 are disposed around the mandrel and adjacent upper and lower cones 56, 58 respectively. Upper and lower gage rings 66, 68 are disposed adjacent to and engage upper and lower slips 62, 64.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. An angled segmented backup ring, comprising:

a longitudinal axis;

a plurality of slots extending radially inward from an outer surface, the plurality of slots extending axially parallel to one another and non-parallel to the longitudinal axis, wherein the plurality of slots do not extend through an inner surface; and a plurality of segments defined by the plurality of slots, wherein each segment is defined by a sequential pair of the plurality of slots, wherein adjacent segments overlap one another in the axial direction when the angled segmented backup ring is radially expanded.

2. The angled segmented backup ring of claim 1, further comprising a sloped inner surface extending radially inward from a first ring end and axially toward a second ring end.

3. The angled segmented backup ring of claim 1, wherein adjacent segments overlap one another when the angled segmented backup ring is radially expanded; and a sloped inner surface extending radially inward from a first ring end and axially toward a second ring end.

4. An isolation device, the device comprising:

a radially expandable tubular seal element having a longitudinal axis;

an expandable angled segmented backup ring having a first ring end disposed adjacent to a first element end of the seal element, the angled segmented backup ring comprising:

a plurality of slots extending radially inward from an outer surface, the plurality of slots extending axially parallel to one another and non-parallel to the longitudinal axis, wherein the plurality of slots extend through the outer surface from the first ring end to a second ring end; and a plurality of segments defined by the plurality of slots, wherein each segment is defined by a sequential pair of the plurality of slots.

5. The device of claim 4, wherein adjacent segments overlap one another in the axial direction when the angled segmented backup ring is radially expanded.

6. The device of claim 4, wherein the plurality of slots do not extend fully through an inner surface.

7. The device of claim 4, further comprising a sloped inner surface extending radially inward from the first ring end and axially toward a second ring end.

8. The device of claim 4, further comprising an element end ring connected to the first element end.

9. The device of claim 4, further comprising a second expandable angled segmented backup ring having a first ring end disposed adjacent to a second element end of the seal element, the second angled segmented backup ring comprising:

a plurality of slots extending radially inward from an outer surface, the plurality of slots extending axially parallel to one another and non-parallel to the longitudinal axis; and a plurality of segments defined by the plurality of slots, wherein each segment is defined by a sequential pair of the plurality of slots.

10. The device of claim 9, wherein adjacent segments overlap one another in the axial direction when the angled segmented backup ring is radially expanded.

11. A method, comprising:

disposing a radially expandable isolation device having a longitudinal axis in a wellbore, the isolation device comprising:

a radially expandable tubular seal element having a first element end and a second element end; and an expandable angled segmented backup ring having a first ring end disposed adjacent to the first element end, the angled segmented backup ring comprising a plurality of slots extending radially inward from an outer surface, the plurality of slots extending axially parallel to one another and non-parallel to the longitudinal axis, wherein the plurality of slots extend through the outer surface from the first ring end to a second ring end, and a plurality of segments defined by the plurality of slots, wherein each segment is defined by a sequential pair of the plurality of slots;

radially expanding the seal element; and radially expanding the angled segmented backup ring.

12. The method of claim 11, wherein adjacent segments overlap one another in the axial direction when the angled segmented backup rings are radially expanded.

13. The method of claim 11, further comprising further comprising an element end ring connected to the first element end.

14. The method of claim 11, further comprising a sloped inner surface extending radially inward from the first ring end and axially toward a second ring end.

15. The method of claim 11, further comprising a second expandable angled segmented backup ring having a first ring end disposed adjacent to the second element end, the second angled segmented backup ring comprising:

a plurality of slots extending radially inward from an outer surface, the plurality of slots extending axially parallel to one another and non-parallel to the longitudinal axis; and a plurality of segments defined by the plurality of slots, wherein each segment is defined by a sequential pair of the plurality of slots.

16. The method of claim 15, wherein adjacent segments overlap one another in the axial direction when the angled segmented backup rings are radially expanded.

* * * * *